US005842625A

United States Patent [19]

Kimura

[11] Patent Number: 5,842,625

[45] Date of Patent: Dec. 1, 1998

[54] NAIL GUIDE DEVICE OF A BOX NAILING MACHINE

[75] Inventor: Youichi Kimura, Tokyo, Japan

[73] Assignee: Max Co., Ltd., Tokyo, Japan

[21] Appl. No.: 951,679

[22] Filed: Oct. 16, 1997

Related U.S. Application Data

[63] Continuation of Ser. No. 557,538, Nov. 14, 1995, abandoned.

[30] Foreign Application Priority Data

Nov. 14, 1994 [JP] Japan ..... 6-279332

[51] Int. Cl.[6] ..... B27F 7/13

[52] U.S. Cl. ..... 227/127; 227/120; 227/130; 227/136

[58] Field of Search ..... 227/127, 128, 227/120, 135, 136, 137, 130, 8

[56] References Cited

U.S. PATENT DOCUMENTS

| | | | |
|---|---|---|---|
| 3,056,137 | 10/1962 | Wandel et al. | 227/127 |
| 3,330,462 | 7/1967 | Coechia et al. | 227/136 |
| 3,494,530 | 2/1970 | Bade | 227/130 |
| 3,524,576 | 8/1970 | Bader | 227/136 |
| 3,543,987 | 12/1970 | Obergfell et al. | 227/136 |
| 3,568,908 | 3/1971 | Bader | 227/120 |
| 3,572,211 | 3/1971 | Doyle | 227/130 |
| 3,580,455 | 5/1971 | Cast | 227/8 |
| 3,661,312 | 5/1972 | Pomernacki | 227/8 |
| 3,820,705 | 6/1974 | Beals | 227/120 |
| 3,946,927 | 3/1976 | Fehrs | 227/127 |
| 4,174,802 | 11/1979 | Maestri | 227/127 |
| 4,197,974 | 4/1980 | Morton et al. | 227/120 |
| 4,389,012 | 6/1983 | Grikis et al. | 227/120 |
| 4,585,154 | 4/1986 | Fealey et al. | 227/128 |
| 4,624,401 | 11/1986 | Gassner et al. | 227/127 |
| 4,784,306 | 11/1988 | Baum | 227/120 |
| 4,801,062 | 1/1989 | Austin | 227/128 |
| 4,942,996 | 7/1990 | Wolfberg et al. | 227/128 |
| 5,020,712 | 6/1991 | Monacelli | 227/120 |
| 5,180,091 | 1/1993 | Ota | 227/120 |
| 5,186,085 | 2/1993 | Monacelli | 227/120 |
| 5,193,730 | 3/1993 | Tanaka et al. | 227/136 |
| 5,368,213 | 11/1994 | Massari, Jr. | 227/127 |
| 5,437,404 | 8/1995 | Shkolnikov | 227/120 |
| 5,579,975 | 12/1996 | Moorman | 227/130 |
| 5,615,819 | 4/1997 | Hou et al. | 227/120 |
| 5,626,274 | 5/1997 | Shkolnikov et al. | 227/128 |
| 5,634,582 | 6/1997 | Morrison, Jr. et al. | 227/128 |
| 5,649,661 | 7/1997 | Masuno et al. | 227/8 |
| 5,683,024 | 11/1997 | Eminger et al. | 227/8 |
| 5,697,541 | 12/1997 | Burke et al. | 227/128 |
| 5,738,266 | 4/1998 | Ogawa | 227/128 |

FOREIGN PATENT DOCUMENTS

| | | |
|---|---|---|
| 0 169 172 | 1/1986 | European Pat. Off. . |
| 1 807 728 | 7/1969 | Germany . |

*Primary Examiner*—Daniel T. Pihulic
*Assistant Examiner*—Darren Ark
*Attorney, Agent, or Firm*—Morgan, Lewis & Bockius LLP

[57] ABSTRACT

A nail guide device of a box nailing machine in which a nail connected with another nail by a tying member is driven by a drive rod, the nail guide device includes: a nail magazine for accommodating the nails connected with each other; a nose for guiding the driver rod; a nail guide plate for connecting the nail magazine with the nose, including, a lower end portion extending downward to a position lower than a tip of the nail, and a guide groove provided in an upper portion of one face of the nail guide plate and extending over the entire length of the guide plate; and a nail cover rotatably provided opposite to the face on which the guide groove is formed, the nail cover and the guide plate forming a nail path, wherein the guide groove is engaged with a side portion of the head of the nail to guide the nail from the nail magazine to the nose; and a flange protruding to the nail path formed in the lower end portion of the nail guide plate so as to shield the tip of the nail.

3 Claims, 4 Drawing Sheets

NAIL GUIDE DEVICE OF A BOX NAILING MACHINE

This application is a continuation of application Ser. No. 08/557,538, filed Nov. 14, 1995, now abandoned.

BACKGROUND OF THE INVENTION

1. Field of the Invention

The present invention relates to a box nailing machine, and more particularly relates to a nail guide device for introducing a nail into a nose portion of the box nailing machine.

2. Description of the Related Art

With reference to FIGS. 3 and 4, a nail guide device of the conventional box nailing machine will be explained below. These drawings show a pneumatic type box nailing machine 1. A hose connector plug 3 of a grip portion 2 is connected with a hose so that compressed air can be supplied from an air compressor (not shown in the drawing). A plunger (not shown in the drawing) is inserted into a cylinder provided in a housing 4. A driver rod fixed to the plunger goes up and down in a nose 6 of the nose unit 5 together with the plunger, so that a nail supplied to the hose 6 can be driven into a work.

A nail guide plate 7 extending backward (downward in FIG. 3) is integrally attached to the nose 6. A nail magazine 8 is attached between a rear end portion of the nail guide plate 7 and a rear end portion of the grip 2. A nail cover 9 is attached to the nose 6. This nail cover 9 can be opened and closed with respect to the nail guide plate 7. The nail guide plate 7 and the nail cover 9 serve as a nail guide device 10. In a clearance between the nail guide plate 7 and the nail cover 9, which forms a path for nails, there is provided a feed claw (not shown in the drawing) which reciprocates being linked with the driver. By the action of the feed claw, nails connected with each other by a tying member, for instance a wire, a plastic sheet or the like are pulled out from the nail magazine 8 and supplied to the nose 6.

As illustrated in FIG. 4, on an upper inner wall face of the nail guide plate 7 of the nose unit 5, there is provided a guide groove 11 extending from the rear end portion on the nail magazine side to the nose 6. When the nails connected with each other are supplied from the nail magazine 8, side portions of the nails are engaged with the guide groove 11, so that the nails are hung from the guide groove 11 and conveyed in the nail path formed by the nail guide plate 7 and the nail cover 9. Width of the nail guide plate 7 with respect to the upward and downward direction is gradually reduced toward the nail magazine 8 side, and lower portions of the nails 12 drawn out from the nail magazine 8 are exposed outside.

In the nail guide device of the conventional box nailing machine, lower portions of the nails are exposed outside between the nail magazine and the nose. Accordingly, there is a possibility that a worker mistakenly puts his hand to the tips of the nails and hurts himself.

On the other hand, when the nails are completely shielded by the nail guide plate and the nail cover, the weight is increased, so that the workability is lowered.

SUMMARY OF THE INVENTION

An object of the present invention is to prevent the nail tips from coming into contact with the worker's hand and suppress an increase in the weight so that the safety can be enhanced without deteriorating the workability.

In order to achieve the object, the present invention provides a nail guide device of a box nailing machine in which a nail connected with another nail by a tying member is driven by a drive rod, the nail guide device including: a nail magazine for accommodating the nails connected with each other; a nose for guiding the driver rod; a nail guide plate for connecting the nail magazine with the nose, including, a lower end portion extending downward to a position lower than a tip of the nail, and a guide groove provided in an upper portion of one face of the nail guide plate and extending over the entire length of the guide plate; and a nail cover rotatably provided opposite to the face on which the guide groove is formed, the nail cover and the guide plate forming a nail path, wherein the guide groove is engaged with a side portion of the head of the nail to guide the nail from the nail magazine to the nose; and a flange protruding to the nail path formed in the lower end portion of the nail guide plate so as to shield the tip of the nail.

In the nail guide device of the present invention, the lower edge portion of the nail guide plate extends downward to a position lower than the tips of nails which are hung from the nail guide plate, and further the lower edge portion of the nail guide plate is bent onto the nail side. Accordingly, the face and tips of the nails supplied to the nose from the nail magazine are covered with the guide plate. Therefore, there is no danger for a worker to put his hand to the nail tips.

BRIEF DESCRIPTION OF THE DRAWINGS

FIG. 2(*b*) is a side view taken on line A—A in FIG. 2(*a*);

FIG. 4(*b*) is a side view taken on line B—B in FIG. 4(*a*).

DETAILED DESCRIPTION OF THE PREFERRED EMBODIMENTS

Figure 1:
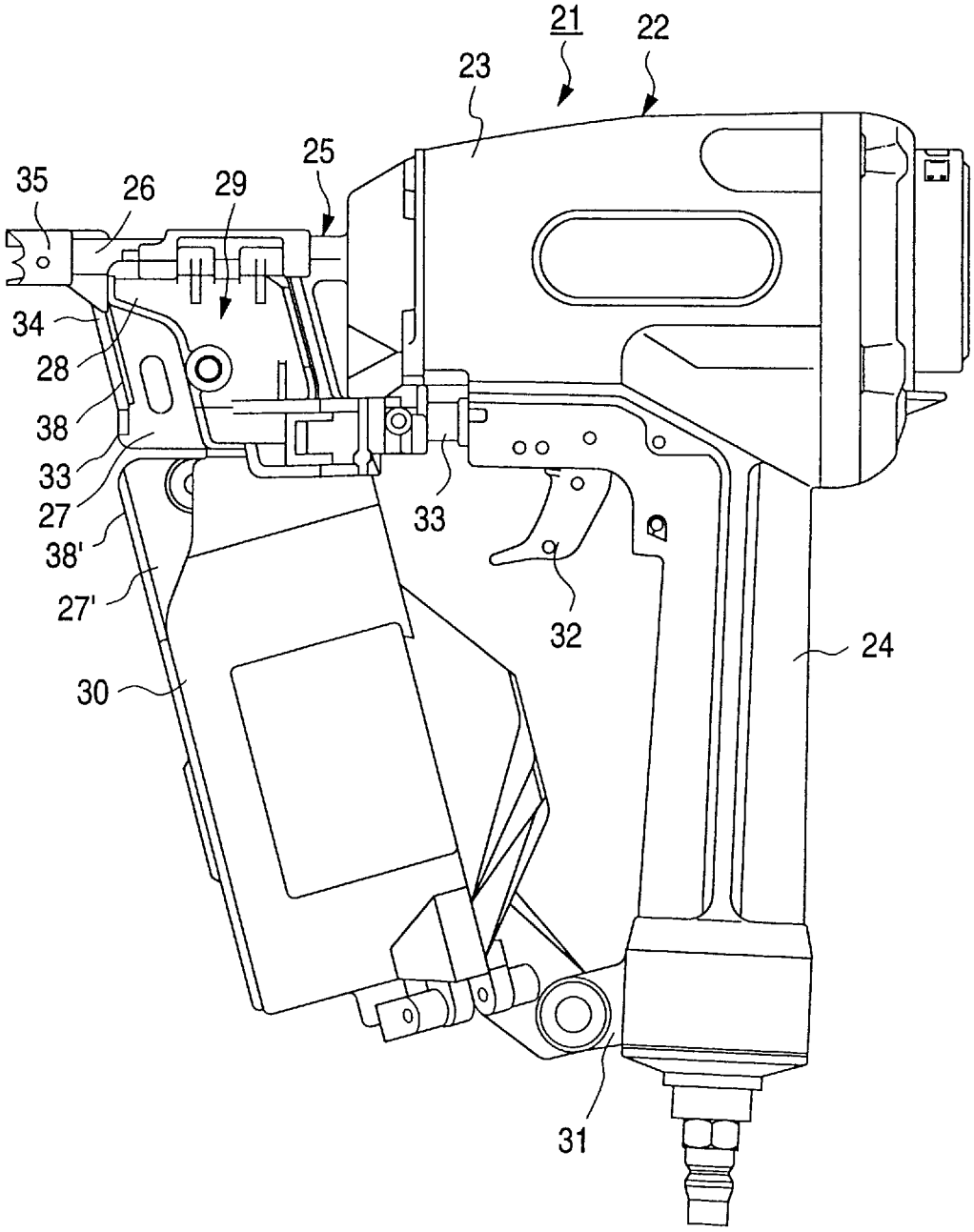
FIG. 1 is a front view of the box nailing machine which is an embodiment of the present invention.
Figure 2:
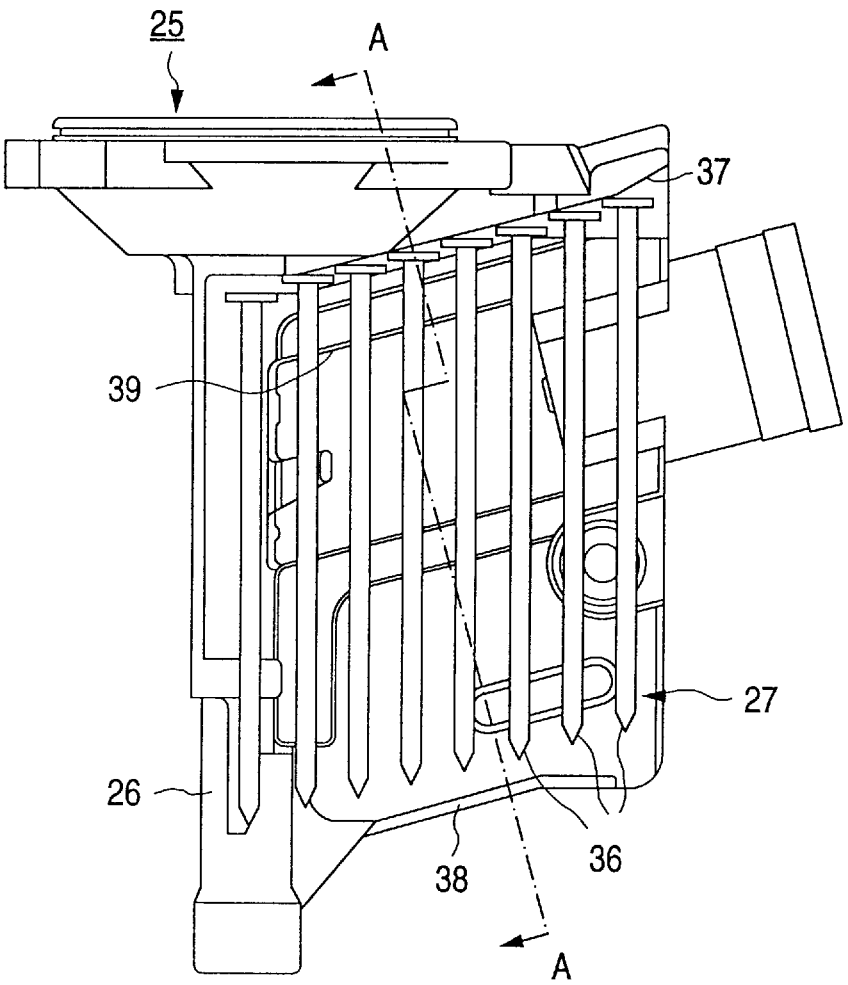
FIG. 2(*a*) is a front view of the nose unit of the box nailing machine shown in FIG. 1.
Figure 2:
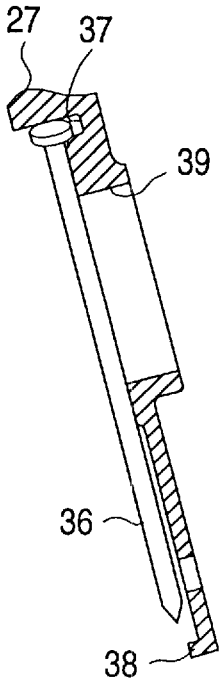
Figure 3:
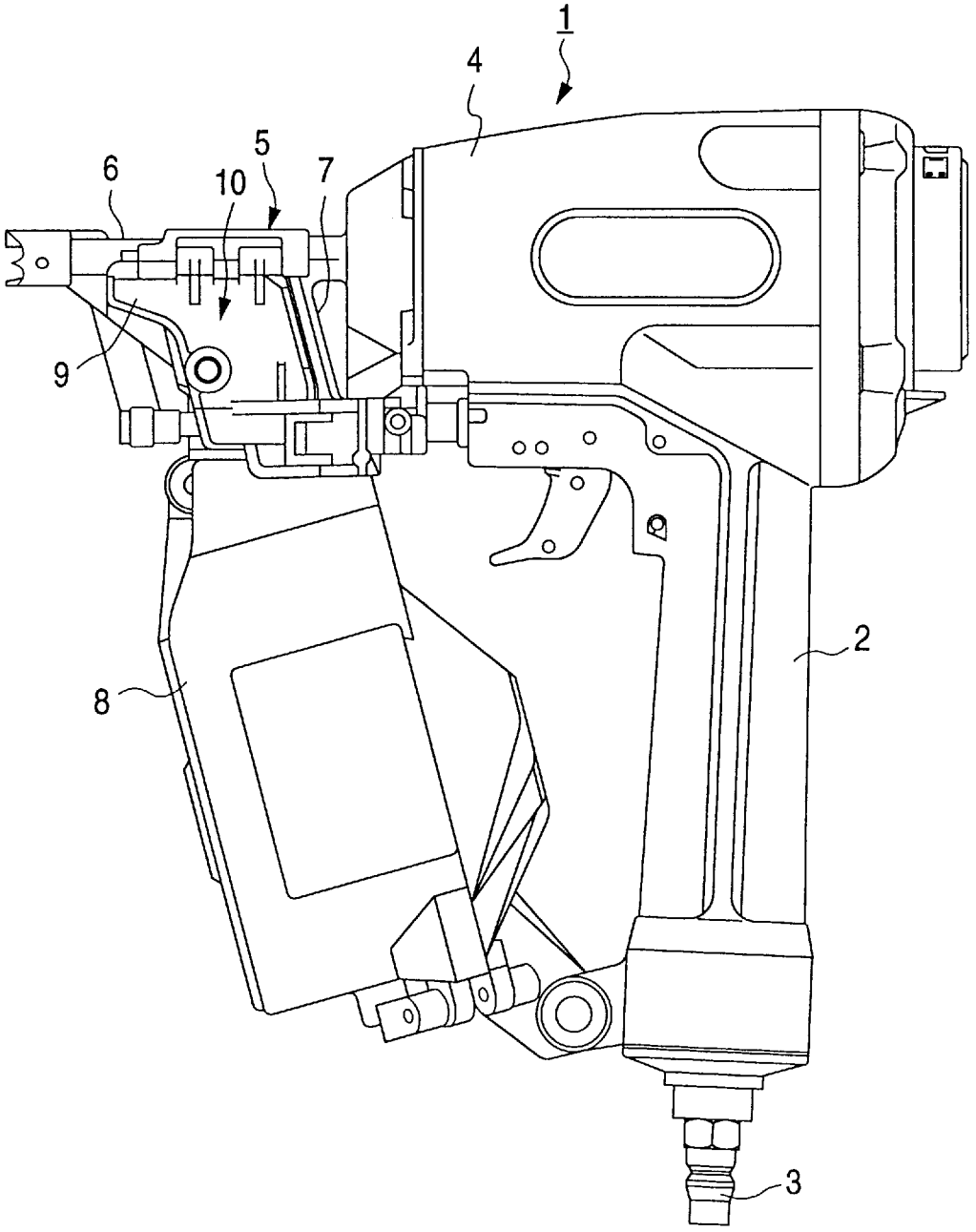
FIG. 3 is a front view of the conventional box nailing machine.
Figure 4:
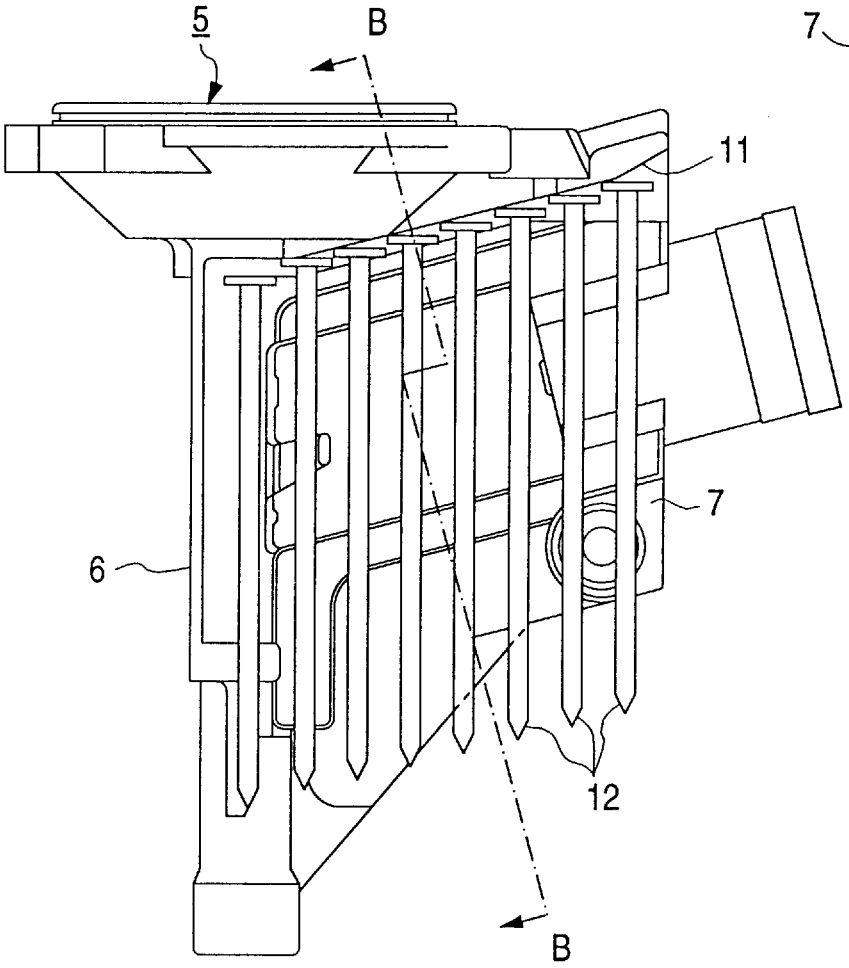
FIG. 4(*a*) is a front view of the nose unit of the box nailing machine shown in FIG. 3.
Figure 4:
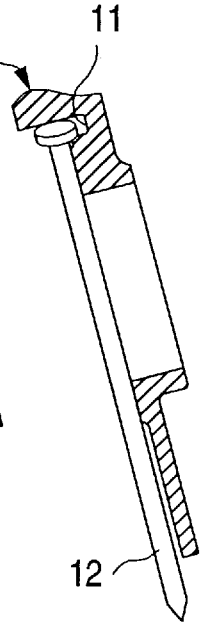

With reference to FIGS. 1 and 2, an embodiment of the present invention will be described in detail as follows. FIG. 1 is an overall arrangement view of the pneumatic type box nailing machine 21. The outer casing 22 of the box nailing machine 21 includes a housing 23 and a grip portion 24 which are integrally molded by means of die casting. There is provided a plunger in the cylinder formed in the housing 23. A driver rod is fixed to the plunger. The driver rod goes up and down along a driver guide hole formed in the nose unit 25 attached to the housing 23. The nose unit 25 has the nose 26 and the nail guide plate 27, which are integrally formed. A nail cover 28 and a nail guide plate 27 are attached onto an outer circumferential surface of the nose 26 via a hinge shaft (not shown in the drawing). The nail cover 28 and the nail guide plate 27 serve as a nail guide device 29.

A nail magazine 30 is connected with a rear end portion of the nail guide plate 27. The nail magazine 30 includes a magazine body with a nail guide portion 27' along the nail guide plate 27, and a lid portion openable and closable with respect to the magazine body. A rear end portion of the nail magazine 30 is fixed to a bracket 31 attached to a portion close to an end of the grip 24.

In a lower portion of the housing 23, there is provided a slide shaft 33, which protrudes forward, for opening and closing a trigger valve (not shown in the drawing) in cooperation with a trigger lever 32. A contact arm 34 is connected with an end portion of the slide shaft 33. A sleeve 35 attached to the fore end of the contact arm 34 is idly engaged with the nose 26. When the sleeve 35 is pressed against a work, the slide shaft 33 is moved backward. When the trigger lever 32 is pulled under this condition, the trigger valve is opened. In other words, unless the sleeve 35 is pressed against the work, the plunger can not start even when the trigger valve 32 is operated. As described above, the well known safety device is provided in the box nailing machine of the invention.

FIG. 2 is an arrangement view of the nose unit 25. A lower end of the nail guide plate 27 extends backward from the nose portion 26. Both the front and the rear end portion of this lower end of the nail guide plate 27 extend downward to positions lower than the tips of the longest nails 36 to be used for this box nailing machine 21. Therefore, one side of the nails 36, the heads of which are hung from the guide groove 37, is shielded by the guide plate 27. A flange 38 is formed at the lower end of the guide plate 27 in such a manner that the lower end of the guide plate is bent onto the nail 36 side so as to make a right angle. Therefore, for example, even when a worker slides his hand upward along the flange 38, he is not brought into contact with the tips of the nails 36. In this connection, there is provided a window 39 at a center of the nail guide plate 27, and a claw (not shown in the drawing) of the nail feed unit which protrudes from the window 39 into the nail path so that the nails can be fed.

The nail guide portion 27' of the magazine 30 extends from the magazine 30 toward the nail guide plate 27. A flange 38' is formed at the lower end of the guide plate 27' such that the lower end of the guide plate 27' is bent onto the nail 36 side so as to make a right angle. The leading end of the nail 36 is prevented from exposing outside at a space between the guide plate 27 and the magazine 30.

When the box nailing machine 21 is used, the operation is conducted as follows. Nails connected with each other are accommodated in the nail magazine 30. The nail cover 28 of the nail guide device 29 illustrated in FIG. 1 is opened, and the head portions of the nails connected with each other are set onto the nail guide portion 27' of the magazine 30 and the nail guide plate 27. Then the nails are engaged with the feed claw, and the nail cover 28 is closed. In the case of driving the nails, they are successively supplied into the nose portion 26 by the feed claw, and the nails connected with each other are moved along the nail guide portion 27' of the magazine 30 and the nail guide plate 27. Since the tips of the nails are shielded by the nail guide plate 27 which extends over the tip of the nail, the nail guide portion 27' and the flanges 38 and 38' formed at the lower portion thereof, there is no possibility that the worker puts his hand to the nail tips.

According to the present invention, one side and tips of the nails supplied from the nail magazine to the nose portion are shielded by the nail guide plate. Accordingly, the worker is not brought into contact with the nails, so that there is no danger of an accidental injury. Unlike a structure in which the overall nails are covered, the structure of the invention is advantageous in that an increase in the weight of members is suppressed and it is possible to visually check the nail feeding condition and the number of residual nails. According to the present invention, it is possible to enhance the safety without deteriorating the workability.

What is claimed is:

1. A nail guide device of a box nailing machine in which a nail connected with another nail by a tying member is driven by a drive rod, said nail guide device comprising:

a nail magazine for accommodating the nails connected with each other;

a nose for guiding the drive rod;

a nail guide plate disposed between said nail magazine and said nose for connecting said nail magazine with the nose, including, a lower end portion extending downward to a position lower than a tip of the nail for an entire length of said nail guide plate, and a face having a guide groove formed in an upper portion thereof which extends over the entire length of said guide plate; and a nail cover provided between said nail magazine and said nose opposite to the face on which said guide groove is formed and extending downward a distance less than the length of the nail, said nail cover and said guide plate forming a nail path, wherein said guide groove is engaged with a side portion of the head of the nail to guide the nail from said nail magazine to the nose; and a flange protruding substantially perpendicular into the nail path formed in said lower end portion of said nail guide plate so as to shield the tip of the nail.

2. A nail guide device of a box nailing machine in which a nail connected with another nail by a tying member is driven by a drive rod, said nail guide device comprising:

a nail magazine for accommodating the nails connected with each other;

a nose for guiding the drive rod;

a nail guide plate disposed between said nail magazine and said nose for connecting said nail magazine with the nose, including, a lower end portion extending downward to a position lower than a tip of the nail for an entire length of said nail guide plate, and a face having a guide groove formed in an upper portion thereof which extends over the entire length of said guide plate; and a nail cover provided between said nail magazine and said nose opposite to the face on which said guide groove is formed and extending downward for a distance less than a length of the nail, said nail cover and said guide plate forming a nail path, wherein said guide groove is engaged with a side portion of the head of the nail to guide the nail from said nail magazine to the nose; and a flange protruding substantially perpendicular into the nail path formed in said lower end portion of said nail guide plate so as to shield only the tip of the nail.

3. The nail guide device according to claim 2, wherein said nail magazine has a lower end portion adjacent to said nail guide plate extending downward to a position lower than the tip of the nail, and a flange formed in said lower end portion of said nail magazine.

* * * * *